United States Patent [19]

Ishikawa et al.

[11] 4,444,873

[45] Apr. 24, 1984

[54] COLOR PHOTOGRAPHIC PROCESSING

[75] Inventors: Takatoshi Ishikawa; Kiyoshi Imai; Mamoru Tashiro; Junya Nakajima, all of Kanagawa, Japan

[73] Assignee: Fuji Photo Film Co., Ltd., Kanagawa, Japan

[21] Appl. No.: 454,310

[22] Filed: Dec. 29, 1982

[30] Foreign Application Priority Data

Dec. 29, 1981 [JP] Japan ..... 56-213112

[51] Int. Cl.[3] ..... G03C 7/00

[52] U.S. Cl. ..... 430/393; 430/429; 430/430; 430/455; 430/461

[58] Field of Search ..... 430/393, 429, 455, 458, 430/449, 461, 430

[56] References Cited

U.S. PATENT DOCUMENTS 3,997,348 12/1976 Shimamura et al. ..... 430/393
4,277,556 7/1981 Koboshi et al. ..... 430/393
4,292,401 9/1981 Itoh et al. ..... 430/461
4,301,236 11/1981 Idota et al. ..... 430/393

*Primary Examiner*—J. Travis Brown
*Attorney, Agent, or Firm*—Sughrue, Mion, Zinn, Macpeak & Seas

[57] ABSTRACT

A process for processing a silver halide color photographic material is disclosed. The process particularly relates to bleaching and fixing of a color developed silver halide color photographic material. The color developed material is processed with an acid bleaching solution containing a ferric salt, inorganic salt and a halide. Immediately after the bleaching step, the photographic material is processed with the fixing solution containing 5 g/l to 50 g/l of polycarboxylic acids. By utilizing the bleaching and fixing steps disclosed it is possible to process a silver halide color photographic material rapidly utilizing a reduced number of baths, obtain an excellent bleaching rate and produce an image having excellent stability.

14 Claims, No Drawings

COLOR PHOTOGRAPHIC PROCESSING

FIELD OF THE INVENTION

The present invention relates to a color photographic processing. In greater detail, it relates to a process for bleaching and fixing developed silver halide photographic emulsion layers.

BACKGROUND OF THE INVENTION

The processing of silver halide color photographic materials comprises a bleaching step and a fixing step.

Examples of known useful bleaching agents include ferricyanides, bichromates, persulfates and iron salts of aminopolycarboxylic acid. However, there are disadvantages with these bleaching agents. For example, ferricyanides and bichromates have high toxicity though they have high bleaching ability. Persulfates and iron salts of aminopolycarboxylic acid have low bleaching ability though they have low toxicity and a solution containing them cannot be easily reused.

Ferric salts are excellent bleaching agent, because they are cheap and have low toxicity and high bleaching ability and it is easy to regenerate a spent bleaching solution containing these salts. These bleaching agents have been described in Japanese Patent Publication No. 14035/70, Japanese Patent Application (OPI) No. 16534/75 (the term "OPI" as used herein refers to a "published unexamined Japanese patent application") and British Pat. No. 1,464,127. However, when ferric salts are carried in the fixing solution it causes a great deal of fatigue of the fixing solution. Further, when these salts remain in the photographic materials cause yellow stains deteriorating the stability of the images. Therefore, in order to prevent the above described disadvantages, water wash is carried out after processing with the bleaching solution, or fixation is carried out after processing with a bath of organic aicd, phosphoric acid or organophosphonic acid when the water wash is insufficient. (Japanese Patent Application (OPI) No. 36126/75 and German Patent Application (OLS) No. 2,732,153.) However, the above described processing is by no means preferable, because it is contrary to the recent requirements of increasing the processing rate, eliminating the discharge of the processing solutions, and the economization of water.

SUMMARY OF THE INVENTION

A primary object of the present invention is to provide a silver halide color photographic processing having an excellent bleaching rate which produces images of excellent stability.

Another object of the present invention is to provide a silver halide color photographic processing which can be carried out rapidly with a reduced number of baths.

As a result of a number of studies, the present inventors have found that the above described objects can be effectively attained by processing a silver halide color photographic material with a fixing solution containing 5 g/l to 50 g/l of polycarboxylic acids immediately after said photographic material is bleached with an acid solution containing ferric salt, organic acid and halide.

DETAILED DESCRIPTION OF THE INVENTION

In general, any ferric salt can be used in the present invention. Water-soluble ferric salts are preferred, examples of which include a ferric halide such as ferric chloride or ferric bromide, ferric nitrate, ferric sulfate, ferric phosphate, ferric perchlorate, ferric ammonium sulfate, ferric citrate, ferric oxalate and ferric acetate, etc.

Among them, the use of the ferric halides such as ferric chloride or ferric bromide and ferric citrate are more preferred.

The organic acid which is the second component in the bleaching solution is used in order to improve the stability of the ferric salts. More specifically, the ferric salts are unstable because they easily form hydroxide in the bleaching solution and precipitate therein. However, this disadvantage can be prevented by the addition of acids and it is possible to use inorganic acids and organic acids. However, organic acids are preferred because inorganic acids sometimes cause corrosion of the processing apparatus due to their strong acidity. However, the function of inorganic acids is not different from that of the organic acids.

The organic acids used in the process of the present invention include monobasic acids and polybasic acids such as dibasic acids. Water-soluble aliphatic carboxylic acids are particularly suitable.

Preferred carboxylic acids are represented by the following general formulae (I) to (IV):

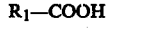

$$R_1\text{—}COOH \qquad \text{(I)}$$

wherein $R_1$ represents an alkyl group (that having 10 or less carbon atoms is preferred and that having 3 or less carbon atoms, such as a methyl group or an ethyl group, etc., is particularly preferred).

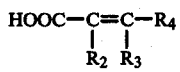

$$HOOC\text{—}\underset{R_2}{\underset{|}{C}}{=}\underset{R_3}{\underset{|}{C}}\text{—}R_4 \qquad \text{(II)}$$

wherein $R_2$ represents hydrogen, a methyl group or a carboxymethyl group, $R_3$ represents hydrogen or a methyl group, and $R_4$ represents a hydrogen or a carboxyl group.

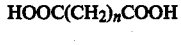

$$HOOC(CH_2)_nCOOH \qquad \text{(III)}$$

wherein n is an integer of 0 to 12.

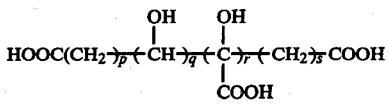

$$HOOC(CH_2)_p\text{—}\overset{OH}{\overset{|}{CH}}\text{—}_q\text{—}\overset{OH}{\overset{|}{\underset{COOH}{\underset{|}{C}}}}\text{—}_r\text{—}(CH_2)_s\text{—}COOH \qquad \text{(IV)}$$

wherein p, q, r and s each represents an integer of 0 to 2, but it accords with the general formula (III) when q=r=0.

Preferred examples of the organic acid used in the present invention include acetic acid, propionic acid, butyric acid, acrylic acid, oxalic acid, malonic acid, succinic acid, glutaric acid, adipic acid, pimelic acid, cork acid, azelaic acid, sebacic acid, nonanedicarboxylic acid, decanedicarboxylic acid, undecanedicarboxylic acid, maleic acid, fumaric acid, citraconic acid, masaconic acid, itaconic acid, malic acid, citric acid and tartaric acid. More preferred examples of the organic acid include citric acid and the water-soluble salts thereof. Particularly preferred examples of the organic acid include a combination of citric acid and the alkali metal salts thereof. However, useful organic acids are not limited to these examples. Two or more kinds of organic acid may be used. Further, the organic acid may be used as water-soluble salts such as alkali metal salts (for example, sodium or potassium salt) or ammonium salts, etc. Further, it may be used as a form of acid anhydride (organic acid hereafter refers to an organic acid itself, the water-soluble salt thereof or the acid anhydride thereof).

The halide which is the third component in the bleaching solution is used for rehalogenating metallic silver by oxidation of ferric salt. Useful halides generally include those which produce light-sensitive silver halide, namely, bromides, iodides and chlorides (particularly, alkali metal salts and ammonium salts thereof) alone or as a combination. Particularly, bromides are advantageously used.

When a ferric halide is used as the ferric salt, it is not always necessary to add the halide. The ferric halides are preferably used in the color photographic processing of the present invention. Particularly preferred examples of the ferric halides include ferric chloride. Preferred examples of the halide other than the ferric halides include potassium bromide, sodium bromide, lithium bromide, ammonium bromide, potassium iodide, lithium iodide, ammonium iodide, potassium chloride, sodium chloride, lithium chloride and ammonium chloride.

Preferable amounts of these components to be added to 1 liter of the bleaching solution are about 10 g to 400 g of ferric salt (particularly 20 g to 300 g), about 5 g to 300 g of organic acid (particularly 10 g to 100 g) and about 2 g to 200 g of halide (particularly 5 g to 100 g). The above described amounts mean practical ranges, and the upper limit thereof is determined based on economic factors. The amount of the ferric salts does not vary, no matter what ferric salts are selected and no matter what other components are used together with the ferric salts. The amount of the organic acids also does not vary, no matter what organic acids are selected and no matter what other components are used together with the organic acids.

The pH of the bleaching solution must be lower than 7, and a bleaching function becomes stronger as the pH is lowered. Practically, a pH of 3 or less is preferred and a pH of 1 or less is more preferred. The bleaching solution may contain pH controllers or pH buffer agents in order to control or maintain the pH within the above described value. Preferred examples of such agents include acids (for example, acetic acid, hydrochloric acid, sulfuric acid, nitric acid and phosphoric acid), alkalis (for example, sodium hydroxide and potassium hydroxide, etc.), and salts (for example, sodium acetate and sodium dihydrogen phosphate).

In the processing steps of the present invention, the photographic material is processed with a fixing solution immediately after it is processed with the above described bleaching solution. More specifically, after the bleaching processing, the photographic material is subjected to fixation processing without carrying out water wash or processing with other baths.

The fixing solution in the present invention is characterized by containign 5 g/l to 50 g/l (preferably 10 g/l to 40 g/l) of polycarboxylic acids. The polycarboxylic acids mean organic compounds having two or more carboxyl groups.

Preferred examples of such compounds include oxalic acid, succinic acid, malonic acid, glutaric acid, adipic acid, fumaric acid, maleic acid, phthalic acid, terephthalic acid, ethylenediaminetetraacetic acid (EDTA), diethylenetriaminepentaacetic acid, ethylenediamine-N-(β-oxyethyl)-N,N',N'-triacetic acid, propylenediaminetetraacetic acid, nitrilotriacetic acid, cyclohexenediaminetetraacetic acid, iminodiacetic acid, alkyliminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diamino-2-propanol tetraacetic acid, triethylenetetraminehexaacetic acid, hydroxyethyleneiminoacetic acid, N-hydroxyethyl ethylenediaminetriacetic acid, oxybis-(ethylene oxynitrilo)tetraacetic acid, malic acid, tartaric acid, citric acid, glutaric acid, adipic acid, lactic acid, crotonic acid, aconitic acid, itaconic acid, diglycolic acid, citraconic acid and phosphonopolycarboxylic acids having the following structures.

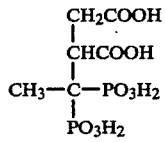
(1)

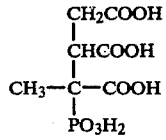
(2)

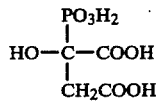
(3)

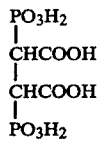
(4)

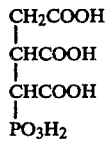
(5)

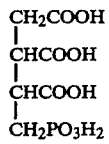
(6)

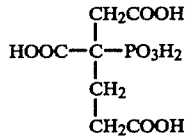
(7)

These polycarboxylic acids may be used as sodium salts or potassium salts thereof. However, the polycarboxylic acids are not limited to the above described compounds.

Among these compounds, particularly preferred examples include aminopolycarboxylic acids such as ethylenediaminetetraacetic acid (EDTA), diethylenetriaminepentaacetic acid, ethylenediamine-N-(β-oxyethyl)-N,N',N'-triacetic acid and propylenediaminetetraacetic acid, etc., and sodium salts and potassium salts thereof.

Examples of other components in the fixing solution include ammonium salt, sodium salt or potassium salt of thiosulfuric acid which is used as a fixer in an amount of 30 g/l to 200 g/l. In addition, stabilizers such as sulfites or metabisulfites, etc., hardeners such as potassium alum, and pH buffer agents such as acetates, borates, phosphates or carbonates, etc., may be incorporated in the fixing solution. It is preferred that the fixing solution has a pH of 3 to 10 and preferably 5 to 9.

The processing of the present invention includes the steps of development, bleaching and fixation. These steps need not always be continuously carried out, except that the bleaching step and fixing step are continuously carried out, and additional steps may be provided before or after each step. Examples of such additional steps include stopping bath, image stabilizing bath, hardening bath and water wash (including rinsing), etc., and, if necessary, additional bleaching and fixing steps can be provided.

The processing temperature during these steps may be within the range conventionally used, but a range of 20° to 40° C. is preferred.

In a color developing solution used in the present invention, known primary aromatic amine developing agents such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.) can be used as color developing agents.

In addition, compounds described in L.F.A. Mason, *Photographic Processing Chemistry* (issued by Focal Press, 1966) pages 226–229, U.S. Pat. Nos. 2,193,015, 2,592,364 and 3,816,134, etc., may be used.

In the present invention, the color developing agent may be incorporated in the color photographic materials. For example, the color developing agent may be contained as a form of precursor or complex salt as described in U.S. Pat. Nos. 2,478,400, 3,342,597, 3,342,599, 3,719,492, 4,214,047, 4,324,856 and 4,157,915, Japanese Patent Application (OPI) Nos. 79035/79 and 89735/81, British Pat. No. 2,056,699 and *Research Disclosure,* Nos. 13924, 14850 and 15159. In this case, the color photographic material can be processed with an alkali bath instead of a color developing bath. After alkali processing, it is subjected to bleaching processing.

The color developing solution or the alkali solution may further contain pH buffer agents such as sulfites, carbonates, borates or phosphates of alkali metals, and development restrainer or antifogging agents such as bromides, iodides or organic antifoggants, etc. If necessary, it may contain preservatives such as hydroxylamine, water softeners, development accelerators such as benzyl alcohol, polyethylene glycol, quaternary ammonium salts or amines, dye forming couplers, competitive couplers, thickening agents, polycarboxylic acid chelating agents described in U.S. Pat. No. 4,083,723, and antioxidizing agents described in German Patent Application (OLS) No. 2,622,950.

In the present invention, the processing may be carried out with a developer which is controlled so as to be supplemented or maintained by the processes described in Japanese Patent Application (OPI) Nos. 84636/76, 119934/77, 46732/78, 9626/79, 19741/79, 37731/79, 1048/81, 1049/81 and 27142/81.

The silver halide color photographic materials used in the present invention may be any color photographic material such as color paper, color negative films or color reversal films, etc., provided thay are processed in the bleaching step and the fixing step. However, this invention works particularly well in connection with color reversal films having a high silver content.

Photographic emulsions used in the present invention can be prepared by processes described in P. Glafkides, *Chimie at Physique Photographique* (issued by Paul Montel Co., 1967), G. F. Duffin, *Photographic Emulsion Chemistry* (issued by The Focal Press, 1966) and V. L. Zelikman et al., *Making and Coating Photographic Emulsion* (issued by The Focal Press, 1964), etc. In general, it is possible to use any acid process, neutral process or ammonia process. Further, for reacting soluble silver salts with soluble halogen salts, it is possible to use a single jet process, a double jet process or a combination thereof.

A process for forming particles in the presence of an excess amount of silver ions (the so-called reversal mixing process) can also be used. An example of a useful type of double jet process is a process wherein the pAg of the liquid phase of forming silver halide is kept at a constant value, namely, the so-called controlled double jet process.

Photographic emulsions of photographic materials which can be used with the present invention include silver bromide, silver iodobromide, silver iodochlorobromide, silver chlorobromide and silver chloride. However, silver iodobromide is particularly preferred.

Cadmium salts, zinc salts, lead salts, thallium salts, iridium salts or complex salts thereof, rhodium salts or complex salts thereof, or iron salts of complex salts thereof, etc., may be coexistent when forming the silver halide particles or during physical ageing.

The photographic emulsions used in the present invention may be spectrally sensitized by methine dyes and others. Examples of dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. Any nuclei conventionally utilized for cyanine dyes as basic heterocyclic nuclei may be utilized.

Examples of useful sensitizing dyes are described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used alone or in combination. Combinations of sensitizing dyes are frequently used for supersensitization. Examples of combinations have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

The emulsions may contain dyes which do not have spectral sensitization function or substances which do not substantially absorb visible light but show supersensitization, together with the sensitizing dyes. For example, they may contain aminostilbene compounds substituted with nitrogen containing heterocyclic groups (for example, those described in U.S. Pat. Nos. 2,933,390 and 3,635,721), aromatic organic acid-formaldehyde condensation products (for example, those described in U.S Pat. No. 3,743,510), cadmium salts and azaindene compounds, etc. Combinations described in U.S. Pat. Nos. 3,615,613, 3,615,641, 3,617,295 and 3,635,721 are particularly useful.

The binder or a protective colloid for the photographic emulsions is preferably gelatin, but other hydrophilic colloids can be used.

Examples of other useful binder or protective colloid include proteins such as gelatin derivatives, graft polymers of gelatin with another high polymer, albumin or casein, etc., saccharose derivatives such as cellulose derivatives such as hydroxyethyl cellulose, carboxymethyl cellulose or cellulose sulfates, etc., sodium alginate or starch derivatives, etc., and various synthetic hydrophilic polymer substances such as homo- or copolymers such as polyvinyl alcohol, polyvinyl alcohol partial acetal, poly-N-vinylpyrrolidone, polyacrylic acid, polymethylacrylic acid, polyacrylamide, polyvinylimidazole or polyvinylpyrazole, etc.

Examples of typical synthetic hydrophilic polymeric substances are described in German Patent Application (OLS) No. 2,312,708, U.S. Pat. Nos. 3,620,751 and 3,879,205 and Japanese Patent Publication No. 7561/68.

The present invention can be applied to multilayer multicolor photographic materials having at least two layers which each have a different spectral sensitivity on a base. Multilayer natural color photographic materials generally have at least a red-sensitive emulsion layer, a green-sensitive emulsion layer and a blue-sensitive emulsion layer on a base. The order of these layers can be suitably determined as occasion demands. Generally, the red-sensitive emulsion layer contains a cyan forming coupler, the green-sensitive emulsion layer contains a magenta forming coupler, and the blue-sensitive emulsion layer contains a yellow forming coupler, but, if necessary, other combinations can be adopted.

In the photographic materials used in the present invention, the hydrophilic colloids layers may contain water-soluble dyes as filter dyes or for purposes such as the prevention of irradiation. Examples of such dyes include oxonol dyes, hemioxonal dyes, styryl dyes, merocyanine dyes, cyanine dyes and azo dyes. Among them, oxonol dyes, hemioxonol dyes and merocyanine dyes are particularly useful. Examples of dyes which can be used are described in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In carrying out the present invention, the following known antifading agents can be used. Further, color image stabilizers may be used alone or as a combination of two or more thereof. Examples of known antifading agents include hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028 and British Pat. No. 1,363,921, etc., gallic acid derivatives described in U.S. Pat. Nos. 3,457,079 and 3,069,262, etc., p-alkoxyphenols described in U.S. Pat. Nos. 2,735,765 and 3,698,909 and Japanese Patent Publication Nos. 20977/74 and 6623/77, p-oxyphenol derivatives described in U.S. Pat. Nos. 3,432,300, 3,573,050, 3,574,627, 3,764,337 and Japanese Patent Application (OPI) Nos. 35633/77, 147434/77 and 152225/77, and bisphenols described in U.S. Pat. No. 3,700,455.

In the photographic materials produced by the present invention, the hydrophilic colloid layers may contain ultraviolet ray absorbing agents. For example, it is possible to use benzotriazole compounds substituted by aryl groups (for example, those described in U.S. Pat. No. 3,533,794), 4thiazolidone compounds (for example, those described in U.S. Pat. Nos. 3,314,794 and 3,352,681), benzophenone compounds (for example, those described in Japanese Patent Application (OPI) No. 2784/71), cinnamic acid esters (for example, those described in U.S. Pat. Nos. 3,705,805 and 3,707,375), butadiene compounds (for example, those described in U.S. Pat. No. 4,045,229) and benzoxazole compounds (for example, those described in U.S. Pat. No. 3,700,455). Further, it is possible to use those described in U.S. Pat. No. 3,499,762 and Japanese Patent Application (OPI) No. 48535/79. Ultraviolet ray absorbing couplers (for example, α-naphthol type cyan dye forming couplers) and ultraviolet ray absorbing polymers, etc., may be used. These ultraviolet ray absorbing agents may be mordanted in a specific layer.

In the photographic materials produced by the present invention, the photographic emulsion layers and other hydrophilic colloid layers may contain whitening agents such as stilbene, triazine, oxazole or coumarin type agents. They may be water-soluble. Further, water-insoluble whitening agents may be used as a dispersion. Examples of the fluorescent whitening agents have been described in U.S. Pat. Nos. 2,632,701, 3,269,840 and 3,359,102 and British Pat. Nos. 852,075 and 1,319,763, etc.

The photographic emulsion layers of the photographic materials of the present invention contain couplers which are capable of coloring by oxidative coupling with an aromatic primary amine developing agent (for example, phenylenediamine derivatives or aminophenol derivatives, etc.) in the color development processing.

Examples of magenta couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78 and 35858/82, etc.

Examples of useful yellow couplers which are preferable include benzoyl acetalinide compounds and pivaloyl acetanilide compounds. Examples of yellow couplers which can be used include those described in U.S. Pat. Nos. 2,875,057, 3,265,506, 3,408,194, 3,551,155, 3,582,322, 3,725,072 and 3,891,445, German Pat. No. 1,547,868, German Patent Application (OLS) Nos. 2,219,917, 2,261,361 and 2,414,006, British Pat. No. 1,425,020, Japanese Patent Publication No. 10783/76, and Japanese Patent Application (OPI) Nos. 26133/72, 73147/73, 102636/76, 6341/75, 123342/75, 130442/75, 21827/76, 87650/75, 82424/77 and 115219/77, etc.

Examples of useful cyan couplers include phenol compounds and naphthol compounds. Specific examples of these couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329, and Japanese Patent Application (OPI) Nos. 59838/73, 26034/76, 5055/73, 146828/76, 69624/77 and 90932/77.

Examples of useful colored couplers are described in U.S. Pat. Nos. 3,476,560, 2,521,908, and 3,034,892, Japanese Patent Publication Nos. 2016/69, 22335/58, 11304/67 and 32461/69, Japanese Patent Application (OPI) Nos. 26034/76 and 42121/77, and German Patent Application (OLS) No. 2,418,959.

Examples of useful DIR couplers are described in U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77 and 122335/74 and Japanese Patent Publication No. 16141/76.

The photographic materials may contain compounds which release a development inhibitor by development in addition to the DIR couplers. For example, it is possible to use those described in U.S. Pat. Nos. 3,297,445 and 3,379,529, German Patent Application (OLS) No. 2,417,914, and Japanese Patent Application (OPI) Nos. 15271/77 and 9116/78.

Two or more kinds of the above described couplers may be contained in the same layer. The same compound may be contained in two or more different layers.

These couplers are generally added in an amount of $2\times10^{-}$mol to $5\times10^{-1}$ mol and preferably $1\times10^{-2}$ mol to $5\times10^{-1}$ mol per mol of silver in the emulsion layer.

The following examples are provided to illustrate the invention in greater detail, but the invention is not limited thereto.

EXAMPLE 1

A red-sensitive silver iodobromide emulsion containing 7% by mol of silver iodide in which a cyan coupler (Compound C-101) was emulsified was applied to a cellulose triacetate film base, and a gelatin intermediate layer was applied thereto. Then, a green-sensitive silver iodobromide containing 7% by mol of silver iodide in which a magenta coupler (Compound M-101) was emulsified was applied, and a yellow colloidal silver layer was applied thereto. Further, a blue-sensitive silver iodobromide emulsion containing 7% by mol of silver iodide in which a yellow coupler (Compound Y-101) was emulsified was applied, and a gelatin protective layer was lastly applied to produce a color negative film (Sample A).

Compound C-101

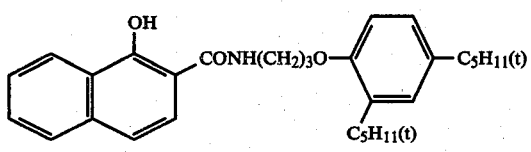

Compound M-101

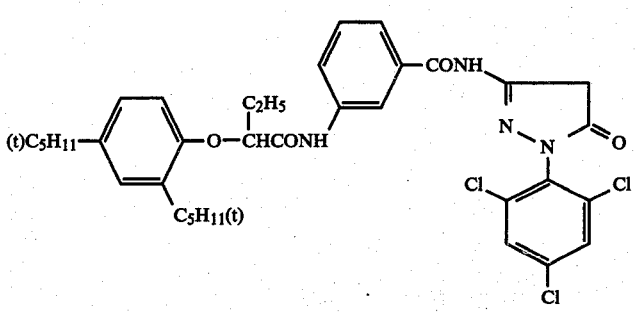

Compound Y-101

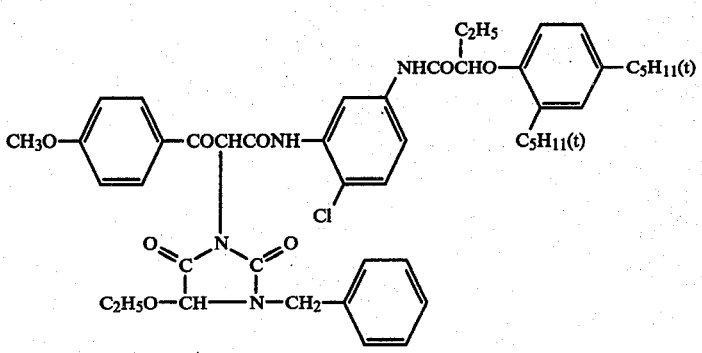

After the Sample A was exposed to light through an optical wedge, it was developed at 38° C. by the following four kinds of processing steps.

| Step | Time |
|---|---|
| Process A (Comparative Example) | |
| Color development | 4 minutes |
| Stopping | 1 minute |
| Water wash | 2 minutes |
| Bleaching (I) | 6 minutes |
| Fixation (I) | 4 minutes |
| Water wash | 3 minutes |
| Total | 20 minutes |
| Process B (Comparative Example) | |
| Color development | 4 minutes |
| Stopping | 1 minute |

-continued

| Step | Time |
|---|---|
| Water wash | 2 minutes |
| Bleaching (II) | 2 minutes |
| Water wash | 1 minute |
| Fixation (I) | 4 minutes |
| Water wash | 3 minutes |
| Total | 17 minutes |
| Process C (Comparative Example) | |
| Color development | 4 minutes |
| Stopping | 1 minute |
| Water wash | 2 minutes |
| Bleaching (II) | 2 minutes |
| Fixation (I) | 4 minutes |
| Water wash | 3 minutes |
| Total | 16 minutes |
| Process D (The Present Invention) | |
| Color development | 4 minutes |
| Stopping | 1 minute |
| Water wash | 2 minutes |
| Bleaching (II) | 2 minutes |
| Fixation (II) | 4 minutes |
| Water wash | 3 minutes |
| Total | 16 minutes |

Processing solutions used had the following compositions.

| | |
|---|---|
| Color Developing Solution | |
| 4-Amino-3-methyl-N—ethyl-N—(β-hydroxyethyl)aniline monosulfate | 5 g |
| Sodium sulfite | 5 g |
| Hydroxylamine sulfate | 2 g |
| Potassium carbonate | 30 g |
| Potassium hydrogencarbonate | 1.2 g |
| Potassium bromide | 1.2 g |
| Sodium chloride | 0.2 g |
| 3 Sodium nitrilotriacetate | 1.2 g |
| pH was adjusted to 10.1 | |
| Water was added to make | 1 l |
| Stopping Solution | |
| Glacial acetic acid | 20 ml |
| Sodium acetate | 8 g |
| Water to make | 1 l |
| Bleaching Solution (I) | |
| Ethylenediaminetetraacetato iron (III) ammonium salt | 100 g |
| 2 Sodium ethylenediaminetetraacetate | 5 g |
| Potassium bromide | 150 g |
| Glacial acetic acid | 10 g |
| pH was adjusted to 6.0 with aqueous ammonia | |
| Water to make | 1 l |
| Bleaching Solution (II) | |
| Citric acid | 50 g |
| Ferric chloride (6 hydrate) | 150 g |
| Potassium bromide | 30 g |
| pH was adjusted to 0.5 | |
| Water to make | 1 l |
| Fixing Solution (I) | |
| Ammonium thiosulfate | 150 g |
| Sodium sulfite | 10 g |
| Sodium hydrogensulfite | 2.5 g |
| pH was adjusted to 6.0 | |
| Water to make | 1 l |
| Fixing Solution (II) | |
| 2 Na salt of ethylenediaminetetraacetic acid | 15 g |
| Ammonium thiosulfate | 150 g |
| Sodium sulfite | 10 g |
| Sodium carbonate | 3 g |
| pH was adjusted to 7.0 | |
| Water to make | 1 l |

The resulting photographic properties are shown in the following Table.

| Processing Step | Minimum Density after Processing | | | Minimum Density after being at 40° C. and 90% RH for 1 Month | | |
|---|---|---|---|---|---|---|
| | B | G | R | B | G | R |
| A (Comparative Example) | 0.45 | 0.30 | 0.15 | 0.60 | 0.37 | 0.19 |
| B (Comparative Example) | 0.46 | 0.29 | 0.16 | 0.67 | 0.36 | 0.19 |
| C (Comparative Example) | 0.55 | 0.31 | 0.16 | 1.04 | 0.40 | 0.23 |
| D (The Present Invention) | 0.46 | 0.29 | 0.15 | 0.52 | 0.37 | 0.19 |

When the bleaching solution and the fixing solution according to the present invention are used the processing time is shortened. Further, the water washing bath between the bleaching bath and the fixing bath becomes unnecessary. In addition, less yellow stains are formed after the processing and the stability of the image is excellent. In Process A, bleaching takes a long time due to the inferior bleaching ability. In Process C, the fixing solution remarkably deteriorates and yellow stains are easily formed, because the iron is not sufficiently washed away.

EXAMPLE 2

To a polyethylene terephthalate base having a subbing layer, a red-sensitive silver iodobromide emulsion containing 5% by mol of silver iodide in which a cyan coupler (Compound C-102) was emulsified was applied, and a gelatin intermediate layer was then applied thereto. A green-sensitive silver iodobromide emulsion contining 5% by mol of silver iodide in which a magenta coupler (Compound M-101) was emulsified was then applied, followed by the application of a yellow colloidal silver layer. Further, a blue-sensitive silver iodobromide emulsion containing 5% by mol of silver iodide in which a yellow coupler (Compound Y-102) was emulsified was applied. Lastly, a gelatin protective layer was applied to produce a color reversal film (Sample B).

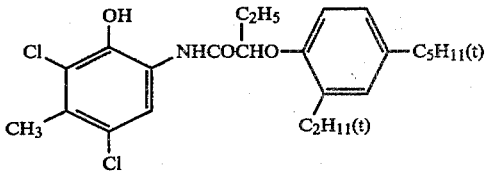

Compound C-102

-continued

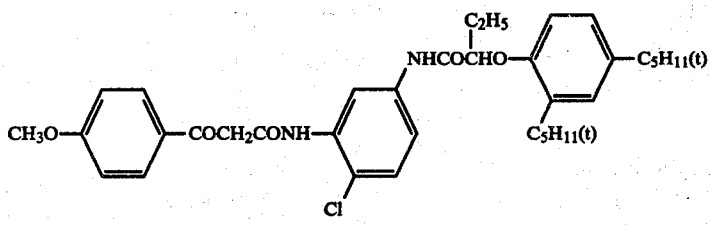

Compound Y-102

After the Sample B was exposed to light through an optical wedge, it was developed at 38° C. by the following three kinds of processing steps.

| Step | Time |
|---|---|
| Process E (Comparative Example) | |
| First development | 3 minutes |
| First stopping | 30 seconds |
| Water wash | 1 minute |
| Color development | 4 minutes |
| Second stopping | 30 seconds |
| Water wash | 1 minute |
| Bleaching | 2 minutes |
| Organic acid | 1 minute |
| Fixation (I) | 2 minutes |
| Water wash | 2 minutes |
| Stabilization | 1 minute |
| Total | 18 minutes |
| Process F (Comparative Example) | |
| First development | 3 minutes |
| First stopping | 30 seconds |
| Water wash | 1 minute |
| Color development | 4 minutes |
| Second stopping | 30 seconds |
| Water wash | 1 minute |
| Bleaching | 2 minutes |
| Fixation (I) | 2 minutes |
| Water wash | 2 minutes |
| Stabilization | 1 minute |
| Total | 17 minutes |
| Process G (The Present Invention) | |
| First development | 3 minutes |
| First stopping | 30 seconds |
| Water wash | 1 minute |
| Color development | 4 minutes |
| Second stopping | 30 seconds |
| Water wash | 1 minute |
| Bleaching | 2 minutes |
| Fixation (II) | 2 minutes |
| Water wash | 2 minutes |
| Stabilization | 1 minute |
| Total | 17 minutes |

Processing solutions used had the following compositions.

| | |
|---|---|
| First Developing Solution | |
| Sodium tetrapolyphosphate | 2.0 g |
| Anhydrous sodium bisulfite | 4.0 g |
| Pyrazon | 0.35 g |
| Anhydrous sodium sulfite | 42.0 g |
| Hydroquinone | 5.5 g |
| Sodium carbonate 1 hydrate | 33.0 g |
| Potassium rhodanide (1 N) | 17.0 ml |
| Sodium bromide | 1.3 g |
| Potassium iodide (0.1%) | 13.0 ml |
| pH was adjusted to 9.90 | |
| Water to make | 1 l |
| First and Second Stopping Solutions | |
| Glacial acetic acid | 30.0 ml |
| Sodium hydroxide | 1.65 g |
| pH was adjusted to 3.50 | |
| Water to make | 1 l |
| Color Developing Solution | |
| Sodium tetrapolyphosphate | 2.0 g |

-continued

| | |
|---|---|
| Benzyl alcohol | 4.5 ml |
| Anhydrous sodium sulfite | 7.5 g |
| Sodium tertiary phosphate 12 hydrate | 36.0 g |
| Sodium bromide | 0.9 g |
| Potassium iodide (0.1%) | 90.0 ml |
| Sodium hydroxide | 3.0 g |
| 4-Amino-N—ethyl-N—(β-methanesulfonamidoethyl)-3-methylaniline monosulfate | 11.0 g |
| Ethylenediamine (98%) | 3.4 ml |
| Sodium boron hydride | 0.07 g |
| pH was adjusted to 11.65 | |
| Water to make | 1 l |
| Bleaching Solution | |
| Citric acid | 50 g |
| Ferric chloride (6 hydrate) | 200 g |
| pH was adjusted to 0.5 | |
| Water to make | 1 l |
| Organic Acid Salt | |
| Sodium citrate | 50 g |
| pH was adjusted to 5.5 | |
| Water to make | 1 l |
| Fixing Solution (I) | |
| 2 Na Salt of ethylenediaminetetraacetic acid | 2.0 g |
| Sodium thiosulfate | 110 g |
| Sodium sulfite | 10 g |
| Sodium hydrogensulfite | 2.5 g |
| pH was adjusted to 6.0 | |
| Water to make | 1 l |
| Fixing Solution (II) | |
| 2 Na Salt of ethylenediaminetetraacetic acid | 20 g |
| Sodium thiosulfate | 110 g |
| Sodium sulfite | 10 g |
| Sodium carbonate | 3 g |
| pH was adjusted to 7.0 | |
| Water to make | 1 l |
| Stabilizing Solution | |
| Formalin (37%) | 6.0 ml |
| Fuji Driwell | 5.0 ml |
| pH was adjusted to 3.5 | |
| Water to make | 1 l |

The resulting photographic properties are shown in the following table.

| Processing Step | Minimum Density after Processing | | | Minimum Density after being at 40° C. and 90% RH for 1 Month | | |
|---|---|---|---|---|---|---|
| | B | G | R | B | G | R |
| E (Comparative Example) | 0.08 | 0.12 | 0.12 | 0.14 | 0.15 | 0.14 |
| F (Comparative Example) | 0.11 | 0.13 | 0.13 | 0.25 | 0.17 | 0.16 |
| G (The Present Invention) | 0.08 | 0.12 | 0.12 | 0.13 | 0.15 | 0.14 |

According to the present invention, photographic properties equal to or superior to those in Process E are obtained in spite of the removal of the organic acid bath, and there are less yellow stains formed after processing.

While the invention has been described in detail and with reference to specific embodiments thereof, it will be apparent to one skilled in the art that various changes and modifications can be made therein without departing from the spirit and scope thereof.

What is claimed is:

1. A process for bleaching and fixing a color developed silver halide color photographic material, comprising the steps of:

processing the photographic material with an acid bleaching solution containing a ferric salt, an organic acid and a halide; and processing the bleached photographic material with a fixing solution containing 5g/l to 50 g/l of polycarboxylic acids.

2. A process for bleaching and fixing as claimed in claim 1, wherein the ferric salt is selected from the group consisting of ferric chloride, ferric bromide and ferric citrate.

3. A process for bleaching and fixing as claimed in claim 2, wherein the ferric salt is selected from the group consisting of ferric chloride and ferric bromide.

4. A process for bleaching and fixing as claimed in claim 1, wherein the organic acid is selected from the group consisting of water-soluble aliphatic carboxylic acids.

5. A process for bleaching and fixing as claimed in claim 4, wherein the organic acid is selected from the group consisting of citric acid and the water-soluble salts thereof.

6. A process for bleaching and fixing as claimed in claim 1, wherein the ferric salts are present in an amount of 10 g to 400 g per liter of bleaching solution.

7. A process for bleaching and fixing as claimed in claim 1, wherein the organic acid is present in an amount of 5 g to 300 g per liter of bleaching solution.

8. A process for bleaching and fixing as claimed in claim 1, wherein the halide is present in an amount of 2 g to 200 g per liter of bleaching solution.

9. A process for bleaching and fixing as claimed in claim 1, wherein the ferric salt is present in an amount of 20 g to 300 g per liter of bleaching solution, the organic acid is present in an amount of 10 g to 100 g per liter of bleaching solution and the halide is present in an amount of 5 g to 100 g per liter of bleaching solution.

10. A process for bleaching and fixing as claimed in claim 1, wherein the bleaching solution has a pH of 3 or less.

11. A process for bleaching and fixing as claimed in claim 10, wherein the bleaching solution has a pH of 1 or less.

12. A process for bleaching and fixing as claimed in claim 1, wherein the fixing solution contains 10 g/l to 40 g/l of polycarboxylic acids.

13. A process for bleaching and fixing as claimed in claim 1, wherein the polycarboxylic acid is selected from the group consisting of ethylenediaminetetraacetic acid, diethylenetriaminepentaacetic acid, ethylenediamine-N-(β-oxyethyl)-N,N', N'-triacetic acid and propylenediaminetetraacetic acid, and sodium and potassium salts thereof.

14. A process for bleaching and fixing as claimed in claim 1, wherein the fixing solution has a pH within the range of 5 to 9.

* * * * *